US009273532B2

(12) United States Patent
Hendrie et al.

(10) Patent No.: US 9,273,532 B2
(45) Date of Patent: Mar. 1, 2016

(54) SECUREMENT ARRANGEMENT FOR SECURING CASING INSIDE A SUBSEA WELLHEAD

(75) Inventors: Craig Francis Bryce Hendrie, Aberdeen (GB); Bernard Herman Van Bilderbeek, Aberdeen (GB); Michael Robertson, Aberdeen (GB)

(73) Assignee: Plexus Holdings, PLC., Aberdeen (GB)

( * ) Notice: Subject to any disclaimer, the term of this patent is extended or adjusted under 35 U.S.C. 154(b) by 0 days.

(21) Appl. No.: 13/877,122

(22) PCT Filed: Oct. 5, 2011

(86) PCT No.: PCT/GB2011/051907

§ 371 (c)(1),
(2), (4) Date: Sep. 10, 2013

(87) PCT Pub. No.: WO2012/046058

PCT Pub. Date: Apr. 12, 2012

(65) Prior Publication Data

US 2013/0341032 A1 Dec. 26, 2013

(30) Foreign Application Priority Data

Oct. 5, 2010 (GB) ..... 1016745.0

(51) Int. Cl.
*E21B 33/04* (2006.01)
*E21B 33/043* (2006.01)

(52) U.S. Cl.
CPC ..... *E21B 33/043* (2013.01)

(58) Field of Classification Search
CPC ..... E21B 23/00; E21B 33/043; E21B 33/035; E21B 33/04; E21B 33/03; E21B 43/103; E21B 33/12; E21B 33/0422; E21B 47/09; E21B 33/085; E21B 33/00
USPC ..... 166/339, 348, 360, 368, 378, 382, 166/75.14; 285/123.1, 123.3
See application file for complete search history.

(56) References Cited

U.S. PATENT DOCUMENTS 1,902,075 A * 3/1933 Howard ..... E21B 33/04 166/85.1
2,620,880 A * 12/1952 Mueller ..... E21B 33/04 166/377

(Continued)

FOREIGN PATENT DOCUMENTS

GB 2362906 A 12/2001
GB 2381023 4/2003

(Continued)

OTHER PUBLICATIONS

International Search Report of the International Searching Authority issued in Application No. PCT/GB2011/051907, date of mailing Oct. 10, 2012, 6 pages.

(Continued)

*Primary Examiner* — Matthew R Buck
*Assistant Examiner* — Edwin Toledo-Duran
(74) *Attorney, Agent, or Firm* — Egan, Peterman, Enders & Huston LLP.

(57) ABSTRACT

A wellhead securement arrangement releasably clamps casing strings such that they cannot move in an upwards or downwards longitudinal direction. Prior to being clamped, the securement arrangement secures the casing strings in a first position whereby cement returns are able to flow around the hangers towards the surface. Once cemented, the casing strings are released and moved upwardly, where the securement arrangement clamps the hangers into position, thus creating an axial load on the casing strings while also preventing movement in the upward and downward longitudinal directions.

27 Claims, 12 Drawing Sheets

(56) References Cited

U.S. PATENT DOCUMENTS 2,683,046 A * 7/1954 Herbert ..... E21B 33/0422 166/75.14
2,690,344 A * 9/1954 Herbert ..... E21B 33/04 166/217
2,748,869 A * 6/1956 Hager ..... E21B 33/0422 166/75.11
3,054,449 A * 9/1962 Schramm ..... E21B 33/043 166/360
3,171,489 A * 3/1965 Cole ..... E21B 33/043 166/368
3,268,241 A * 8/1966 Word, Jr. ..... E21B 33/043 166/368
3,268,243 A * 8/1966 Word, Jr. ..... E21B 33/035 166/368
3,301,322 A * 1/1967 Newsome ..... A01B 39/26 166/339
3,335,799 A * 8/1967 Miller ..... E21B 33/04 166/124
3,411,588 A * 11/1968 Hanes ..... E21B 33/043 166/208
3,468,558 A * 9/1969 Ahlstone ..... E21B 33/043 166/340
3,468,559 A * 9/1969 Ahlstone ..... E21B 33/043 166/332.5
3,543,847 A * 12/1970 Haeber ..... E21B 33/043 166/115
3,628,604 A * 12/1971 Childers ..... E21B 33/0415 166/338
3,693,714 A * 9/1972 Baugh ..... E21B 33/047 166/348
3,771,603 A * 11/1973 Crowe ..... E21B 23/06 166/322
4,408,783 A * 10/1983 Gruller ..... E21B 33/043 166/217
4,903,776 A * 2/1990 Nobileau ..... E21B 33/043 166/182
4,919,454 A * 4/1990 Caulfield ..... E21B 17/06 166/338
4,949,793 A * 8/1990 Rubbo ..... E21B 23/00 166/134
RE34,071 E * 9/1992 Van Bilderbeek .... E21B 33/043 166/342
5,240,076 A * 8/1993 Cromar ..... E21B 23/01 166/208
5,366,017 A * 11/1994 Voss, Jr. ..... E21B 33/0355 166/368
5,439,061 A * 8/1995 Brammer ..... E21B 33/043 166/208
5,450,905 A * 9/1995 Brammer ..... E21B 33/043 166/123
5,464,063 A * 11/1995 Boehm, Jr. ..... E21B 33/04 166/208
5,553,672 A * 9/1996 Smith, Jr. ..... E21B 43/10 166/120
5,653,289 A * 8/1997 Hosie ..... E21B 33/038 166/141
5,671,812 A 9/1997 Bridges
5,878,816 A * 3/1999 Lalor ..... E21B 33/043 166/268
5,941,530 A * 8/1999 Williams ..... E21B 33/035 277/322
5,996,697 A * 12/1999 Vick ..... E21B 23/04 166/115
6,050,338 A * 4/2000 Watkins ..... E21B 34/04 166/348
6,053,252 A * 4/2000 Edwards ..... E21B 19/22 166/338
6,109,353 A * 8/2000 Edwards ..... E21B 17/01 166/344
6,170,578 B1 * 1/2001 Edwards ..... E21B 23/002 166/339
6,419,021 B1 * 7/2002 George ..... E21B 7/061 166/242.5
6,419,024 B1 * 7/2002 George ..... E21B 7/061 166/117.5
6,516,887 B2 * 2/2003 Nguyen ..... E21B 33/038 166/208
6,520,263 B2 * 2/2003 June ..... E21B 33/043 166/348
6,612,368 B2 * 9/2003 Kent ..... B24B 37/04 166/75.13
6,675,900 B2 * 1/2004 Baskett ..... E21B 33/043 166/368
6,871,708 B2 * 3/2005 Calder ..... E21B 41/0057 166/348
6,899,183 B2 * 5/2005 Dewey ..... E21B 23/01 166/138
6,976,539 B2 * 12/2005 Metcalfe ..... B21D 17/04 166/208
7,011,162 B2 * 3/2006 Maguire ..... E21B 17/05 166/242.6
7,025,132 B2 * 4/2006 Kent ..... E21B 33/0355 166/368
7,111,688 B2 * 9/2006 vanBilderbeek ..... E21B 19/004 166/242.6
7,380,607 B2 * 6/2008 Thomas ..... E21B 33/038 166/208
7,581,595 B2 * 9/2009 Fay ..... E21B 23/01 166/208
7,779,910 B2 * 8/2010 Watson ..... E21B 43/105 166/208
2001/0054507 A1 * 12/2001 Bartlett ..... E21B 33/0355 166/368
2002/0029887 A1 * 3/2002 Baskett ..... E21B 33/043 166/368
2002/0092656 A1 * 7/2002 Ford ..... E21B 17/1007 166/377
2002/0189813 A1 * 12/2002 Bartlett ..... B24B 37/04 166/368
2003/0121667 A1 * 7/2003 Massie ..... E21B 33/076 166/344
2004/0206509 A1 10/2004 Slack
2005/0126788 A1 * 6/2005 Crozier ..... E21B 33/047 166/345
2005/0139360 A1 * 6/2005 Van Bilderbeek .. E21B 33/0422 166/382
2006/0196673 A1 * 9/2006 Pallini ..... E21B 33/038 166/368
2007/0023189 A1 * 2/2007 Kahn ..... E21B 33/043 166/348
2007/0034382 A1 2/2007 Van Bilderbeek
2007/0204999 A1 * 9/2007 Cowie ..... E21B 33/035 166/368
2009/0078404 A1 * 3/2009 Schepp ..... E21B 33/04 166/75.14
2010/0116488 A1 * 5/2010 Baskett ..... E21B 33/043 166/153
2010/0252278 A1 * 10/2010 Harris ..... E21B 23/01 166/382
2011/0147001 A1 * 6/2011 Thomson ..... E21B 33/043 166/348
2012/0061101 A1 * 3/2012 Angelle ..... E21B 19/07 166/382
2012/0097399 A1 * 4/2012 Kobata ..... E21B 33/043 166/348

FOREIGN PATENT DOCUMENTS

GB 2362906 B 9/2004
WO WO 2006/078230 A1 7/2006

OTHER PUBLICATIONS

Written Opinion of the International Searching Authority issued in Application No. PCT/GB2011/051907, date of mailing Oct. 10, 2012, 7 pages.
Search Report Under Section 17(5) issued by the United Kingdom Intellectual Property Office dated Apr. 9, 2010, 3 pages.
Search Report, GB1016745.0, Nov. 23, 2010, 2 pgs.

* cited by examiner

SECUREMENT ARRANGEMENT FOR SECURING CASING INSIDE A SUBSEA WELLHEAD

CROSS-REFERENCE TO RELATED APPLICATIONS

This is the U.S. national-stage of PCT International Patent Application No. PCT/GB2011/051907, filed Oct. 5, 2011, which claims the benefit of Great Britain Application No. 1016745.0, filed Oct. 5, 2010; the contents of each of which is specifically incorporated herein in its entirety by express reference thereto.

FIELD OF THE INVENTION

The present invention relates to a subsea wellhead, a securement arrangement for a subsea wellhead and a method of securing a casing within a subsea wellhead.

BACKGROUND TO THE INVENTION

Deep water wells are increasingly being used to extract hydrocarbons. Such deep water wells were previously not considered economical. However, the lack of readily available and easily accessible fields has encouraged significant developments in the extraction of hydrocarbons using deep water wells. However, such deep water wells still have many problems and disadvantages compared to shallow water wells.

In conventional oil and gas wells, it is conventional to have a number of concentric tubes or casings. The outermost casing is secured and fixed in the ground and, in particular, it is fixed within the sea bed. The concentric inner casings are then each secured within the outer casing by being secured to the next adjacent outer casing. Typically, a casing includes a hanger at an upper end thereof. The hanger includes an external shoulder collar which sits on and engages with an internally projecting shoulder the outer casing. Accordingly, the inner casing is effectively supported on and "hung" from the outer casing. Once positioned on the shoulder, cement may be supplied to the annular space defined between the outer surface of the inner casing and the inner surface of the outer casing. This thereby bonds the inner casing to the outer casing. The outer casing may have a return valve operable by a Remote Operated Vehicle located at or adjacent to the mudline. As the cement is pumped down into the annular spacing the excess cement can pass out through valve.

A typical well will include several concentric casings. For example, the outer casing may be cemented to a first inner casing which may support a second inner casing which may support a third inner casing etc. It will be appreciated that it is relatively easy for the excess cement between the outer casing and the first inner casing to be easily extracted out of the well through a valve located at the mudline in the outer casing. However, it becomes increasingly difficult to simply extract the excess cement from between successive inner casings whilst maintaining the integrity of the subsea wellhead.

In addition, it is preferable to have the inner concentric casings locked down such that the casing is not lifted upwards by any excess pressure or force produced in the annular space surrounding it. Such lockdown connectors may require the hanger to have a locking arrangement which can be relatively difficult to operate and manipulate since the lockdown connectors are located a long distance from the surface. Furthermore, such lockdown arrangements may be complex and may not provide any axial loading on the casing string.

Prior art systems may include multiple components including annular sealing components for creating the required seal, locking components for locking a well casing string against downwards movement and also locking components for locking the well casing string against upwards movement. Each of these components requires activation or actuation which may only occur whilst they are located at a deep sea level. Accordingly, these multiple components and the activations can be difficult and problematic.

It is an aim of the present invention to overcome at least one problem associated with the prior art whether referred to herein or otherwise.

SUMMARY OF THE INVENTION

According to a first aspect of the present invention there is provided a securement arrangement for securing a hanger within a subsea wellhead comprising first securement means to secure the hanger in a first position and second securement means to secure the hanger in a second position, the first securement means being arranged, in use, to provide a fluid passageway over an outer sealing surface of the hanger whilst the hanger is retained in the first position such that fluid can flow around the outer sealing surface of the hanger, the second securement means comprising a clamping arrangement in order to provide a seal around the hanger whilst the hanger is secured in the second position such that fluid cannot flow around the outer sealing surface of the hanger.

Preferably the second securement means secures the hanger in a first longitudinal direction and in an opposite second longitudinal direction in order to prevent movement of the hanger in either longitudinal direction.

Preferably the second securement means provides an axial loading on a casing secured below the hanger. Preferably the casing is secured within the well by cement.

Preferably the first securement means secures the hanger in a single longitudinal direction and may enable movement of the hanger in the second opposite longitudinal direction.

Preferably the first securement means comprises a retaining shoulder which is arranged, in use to cooperate with a retaining surface on the hanger in order to suspend the hanger in the first position.

Preferably the retaining shoulder is provided on a section of tube already suspended or secured within the wellhead.

The retaining shoulder may be provided by a sleeve already secured within the subsea wellhead.

The retaining shoulder may be provided by a hanger already secured within the subsea wellhead.

Preferably in the first position an outer sealing surface of the hanger is arranged to locate at a longitudinal position in which the outer sealing surface is spaced apart from an inner surface provided in the wellhead in order to define an annular flow path around the outer sealing surface.

The first securement means may comprise a fluid passageway groove defined around an internal surface of a tube in the wellhead.

The first securement means may comprise an enlarged diameter on an internal sleeve or tube in the subsea wellhead.

The retaining shoulder may be provided by an upper surface of a tube already suspended or secured within the wellhead.

Preferably the hanger comprises a plurality of splines or longitudinal ribs on an outer surface thereof.

The hanger may comprise a plurality of radial ribs on a lower annular surface thereof.

Preferably a lower surface of the splines or longitudinal ribs or radial ribs provides the retaining surface on the hanger.

Preferably a lower surface of the splines or longitudinal ribs is arranged in use to abut and to be supported on a support or retaining surface in the wellhead.

Preferably the splines or longitudinal ribs are spaced radially around the circumference of the outer surface of the hanger. Preferably the splines or longitudinal ribs are equally spaced around the circumference of the outer surface of the hanger.

The radial ribs may be spaced radially around the circumference of the lower annular surface of the hanger. Preferably the radial ribs are equally spaced around the circumference of the lower annular surface of the hanger.

Preferably radially adjacent splines or longitudinal ribs or radial ribs define a fluid passageway therebetween.

Preferably the splines or longitudinal ribs extend upwardly from a lower position to an outer sealing surface of the hanger.

The hanger may comprise further splines or longitudinal ribs located above the outer sealing surface. Preferably the further splines or longitudinal ribs register with the splines or ribs located below the outer sealing surface and the two sets of splines or longitudinal ribs may effectively comprise a single set having an outer sealing surface located in-between.

Preferably the outer sealing surface comprises an outer metal surface to create a metal to metal seal in the second position.

The outer sealing surface may comprise an O-ring seal and preferably comprises two O-ring seals longitudinally spaced apart on the outer surface of the hanger.

Preferably the fluid passageway enables cement returns to flow up from the annular space around the hanger.

Preferably the hanger comprises a casing secured at a lower end thereof.

Preferably the fluid passageway enables cement returns to flow up from the annular space around the hanger and the suspended casing.

Preferably the securement arrangement enables cement to flow down the casing and then up around the outer surface of the casing and cement returns may then flow up around the hanger and upwardly therefrom.

Preferably the securement arrangement prevents fluid and, in particular liquid, flowing around the hanger whilst the hanger is secured in the second position.

The securement arrangement may comprise a lower securement arrangement and an upper securement arrangement.

The lower securement arrangement may comprise a lower first securement means to secure a lower hanger in a first position and lower second securement means to secure the lower hanger in a second position, the lower first securement means being arranged, in use, to provide a fluid passageway over an outer sealing surface of the lower hanger whilst the lower hanger is retained in the first position such that fluid can flow around the outer sealing surface of the lower hanger, the lower second securement means comprising a lower clamping arrangement in order to provide a seal around the lower hanger whilst the lower hanger is secured in the second position such that fluid cannot flow around the outer sealing surface of the lower hanger.

The upper securement arrangement may comprise an upper first securement means to secure an upper hanger in a first position and upper second securement means to secure the upper hanger in a second position, the upper first securement means being arranged, in use, to provide a fluid passageway over an outer sealing surface of the upper hanger whilst the upper hanger is retained in the first position such that fluid can flow around the outer sealing surface of the upper hanger, the upper second securement means comprising a upper clamping arrangement in order to provide a seal around the upper hanger whilst the upper hanger is secured in the second position such that fluid cannot flow around the outer sealing surface of the upper hanger.

The upper hanger may comprise a tubular casing suspended therefrom which is arranged, in use, to locate within a tubular casing suspended from the upper hanger.

The lower securement arrangement may be provided within a lower wellhead housing. The upper securement arrangement may be provided within an upper wellhead housing. The upper wellhead housing may be supported on the lower wellhead housing.

Preferably the second securement means comprises a clamping arrangement for clamping the hanger of a first tubular well casing wherein the clamping arrangement comprising a collar having an externally tapered surface, the arrangement also including an annular component with an internally tapered surface, the collar and the annular component being relatively axially moveable between a first position in which the tapered surface of the annular component exerts no radial force on the collar and a second position which the tapered surface of the annular component exerts sufficient radial force to distort the collar inwardly to grip the hanger of the first tubular well casing.

Preferably the annular component comprises a compression ring.

Preferably the collar comprises a compression collar.

The compression collar may have an axially extending groove provided on the outer periphery and preferably the compression collar has a plurality of axially extending grooves provided radially around the outer periphery.

Preferably the tubular well casing extends downwardly towards a field and/or into the seabed.

Preferably the arrangement includes a sleeve which is arranged, in use, to locate between an inner surface of the collar and outer surfaces of the hanger.

Preferably the sleeve is arranged, in use, to be connected at an upper end to a surface casing which extends upwardly towards the sea surface.

Preferably the sleeve is arranged, in use, to be connected at a lower end to a surface casing which extends downwardly towards a field and preferably below the mudline.

Preferably the sleeve comprises a compression sleeve.

Preferably the arrangement includes movement means for moving the annular component relative to the collar. Preferably the movement means comprises hydraulic movement means.

The movement means may comprise a chamber between the annular component and the upper clamping housing component, and the chamber may be pressurised to urge the annular component away from the upper clamping housing component.

The clamping arrangement may comprise hydraulic fluid introduction means to introduce hydraulic fluid into the chamber in order to urge the annular component away from the upper clamping housing component.

The movement means may comprise a piston. Preferably the movement means comprises a plurality of pistons. Preferably the pistons are arranged radially around the annular component.

The or each piston may be mounted on a clamping housing and preferably on an upper clamping housing component. Preferably the upper clamping housing component is mounted to a lower end of a conductor which extends upwardly towards the sea surface. The or each piston may be arranged to extend downwardly from the clamping housing and to move the collar downwardly away from the clamping housing.

The sleeve is preferably a component which may be either threaded onto a casing or may be located in a suitable locating and receiving area on the casing.

The clamping arrangement may comprise locking means to lock the annular component in the second position. The locking means may comprise a locking member which engages in a locking recess provided in a lower clamping housing component. Preferably the locking means comprises a plurality of locking members.

The locking member may comprise a locking finger.

The locking finger may comprise a resilient component that is inherently urged into engagement with the locking recess at the locking position or when the annular component reaches the second position.

The locking means may comprise lock release means. Preferably the lock release means is arranged to disengage the or each locking member from the locking recess.

The lock release means may comprise movement means to move the locking member out of engagement with the locking recess. The lock release means may comprise a piston and preferably comprises a hydraulic piston.

The clamping arrangement may comprise return movement means to move the annular component from the second position towards the first position. In particular, the return movement means may aid the release of the clamping force from between the annular component and the collar.

Preferably the return movement means comprises a chamber between the annular component and the lower clamping housing component, and the chamber may be pressurised to urge the annular component away from the lower clamping housing component.

The movement means may comprise a piston. Preferably the movement means comprises a plurality of pistons. Preferably the pistons are arranged radially around the annular component.

The or each piston may be mounted on a lower clamping housing component. Preferably the lower clamping housing component is mounted to an upper end of a conductor which extends downwardly away from the sea surface and/or below the mudline. The or each piston may be arranged to extend upwardly from the lower clamping housing component and to move the collar upwardly away from the lower clamping housing component.

Preferably the clamping arrangement comprises a subsea clamping arrangement.

Preferably the subsea wellhead provides a well extending in a longitudinal direction from a first upper end to a second lower end.

Preferably the second securement means simultaneously creates a seal for a casing string suspended from the hanger whilst creating a lockdown mechanism for preventing both upwards movement and downwards movement of the casing string.

Preferably the second securement means simultaneously creates a metal-to-metal seal for a casing string suspended from the hanger whilst creating a lockdown mechanism for preventing both upwards movement and downwards movement of the casing string.

The arrangement may include monitoring means for monitoring an annular space located below the hanger.

The monitoring means may monitor an annular space located below (or on a first side of) the hanger, the annular space being located between an outer surface of an inner casing and an inner surface of an outer casing.

Preferably the monitoring means comprising a sleeve securable within the wellhead wherein the sleeve includes a monitoring fluid passageway which fluidly connects the annular space to a monitoring aperture located above (or on a second side of) the hanger, the monitoring means further comprising a monitoring sensor located above (or on a second side of) the hanger.

The sleeve may be arranged to encompass the hanger.

Preferably the hanger comprises a casing secured at a lower end thereof. The casing may be suspended from the hanger. Preferably the casing secured from the hanger provides the inner casing, the outer surface of which defines the annular space together with an inner surface of an outer casing.

Preferably the sleeve comprises a section of a casing.

Preferably the sleeve comprises a casing secured at a lower end thereof. The casing may be suspended form the sleeve. Preferably the casing secured from the sleeve provides the outer casing, the inner surface of which defines the annular space together with an outer surface of an inner casing.

The hanger may support a casing and wherein the monitoring means monitors the annular space located between an outer surface of the casing and an inner surface of an outer casing.

Preferably the monitoring means comprises a sleeve secured within the wellhead, wherein the sleeve includes a monitoring fluid passageway which connects the annular space to a monitoring aperture located above the hanger.

Preferably the sleeve is arranged to secure the hanger within the wellhead.

Preferably the sleeve comprises first securement means and second securement means to secure the hanger in a first position and a second position.

Preferably a lower end of the sleeve locates below a sealing surface of the hanger in the first position and/or in the second position.

The sleeve may extend between a lower securement arrangement and an upper securement arrangement.

Preferably the monitoring fluid passageway provides a fluid communication bypass to enable fluid to be introduced into and/or extracted from the annulus.

The monitoring means may comprise a fluid sensor located above the hanger.

The monitoring means may comprise a monitoring hanger.

The monitoring hanger may comprise a monitoring fluid passageway which is aligned with an aperture of a fluid passageway in a sleeve and wherein the monitoring hanger further comprises a monitoring port for connection with communication means to communicate from the subsea wellhead to the surface.

Preferably the communication means is selectively engageable and disengageable with the monitoring port.

The monitoring means may comprise an isolation sleeve which is securable above the hanger and wherein the isolation sleeve seals an open aperture provided by a monitoring fluid passageway within a sleeve in which the hanger is located.

Preferably the securement arrangement comprises a clamping arrangement for clamping the hanger. The securement arrangement may include a first clamping arrangement for clamping the hanger and a second clamping arrangement for clamping a part of the monitoring means above the hanger. The second clamping arrangement may clamp an isolation sleeve above the hanger. The second clamping arrangement may clamp a monitoring hanger above the hanger.

The first clamping arrangement and/or the second clamping arrangement may be arranged to exert sufficient radial force to distort the sleeve inwardly to grip the hanger and/or the isolation sleeve and/or the monitoring hanger.

Preferably the sleeve is arranged, in use, to locate between an inner surface of a part of the first clamping arrangement and an outer surface of the hanger.

Preferably the sleeve is arranged, in use, to locate between an inner surface of a part of the second clamping arrangement and an outer surface of the isolation sleeve or the monitoring hanger.

Preferably the monitoring fluid passageway does not penetrate a casing of the wellhead.

Preferably the sleeve comprises a cylindrical section of a casing including an inner surface and an outer surface.

Preferably the monitoring fluid passageway is provided in the sleeve and includes an inlet on an inner surface of the sleeve, a extending section which connects the inlet to an outlet, and the outlet being located on the inner surface of the sleeve. Preferably the extending section extends (primarily) in the longitudinal direction of the sleeve. The extending section may include a radially extending section. The extending section may extend simultaneously radially outwardly and longitudinally and then radially inwardly along a radius of the sleeve.

The monitoring fluid passageway may provide remediation means remedying pressure build-up in the annulus. Preferably the remediation means is arranged to bleed off the pressure from the annulus. Preferably, the remediation means is arranged to introduce a remediation fluid to seal a part of the annulus. The remediation means may be arranged, in use, to remedy Sustained Casing Pressure (SCP)). The remediation means may be arranged to bleed off the pressure, or to introduce a remediation fluid, such as drilling mud to kill the leak, or cement to seal it.

According to a second aspect of the present invention there is provided a subsea wellhead including a securement arrangement for securing a hanger within the subsea wellhead, the securement arrangement being in accordance with the first aspect of the present invention.

According to a third aspect of the present invention there is provide a method of securing a hanger within a subsea wellhead comprising securing the hanger in a first position with first securement means and providing a fluid passageway over an outer sealing surface of the hanger whilst the hanger is retained in the first position such that fluid can flow around the outer sealing surface of the hanger, the method comprising moving the hanger from the first position to a second position and securing the hanger in the second position with second securement means and clamping the hanger in order to provide a seal around the hanger whilst the hanger is secured in the second position such that fluid cannot flow around the outer sealing surface of the hanger.

BRIEF DESCRIPTION OF THE DRAWINGS

The present invention will now be described, by way of example only, with reference to the drawings that follow, in which.

DETAILED DESCRIPTION

Figure 1:
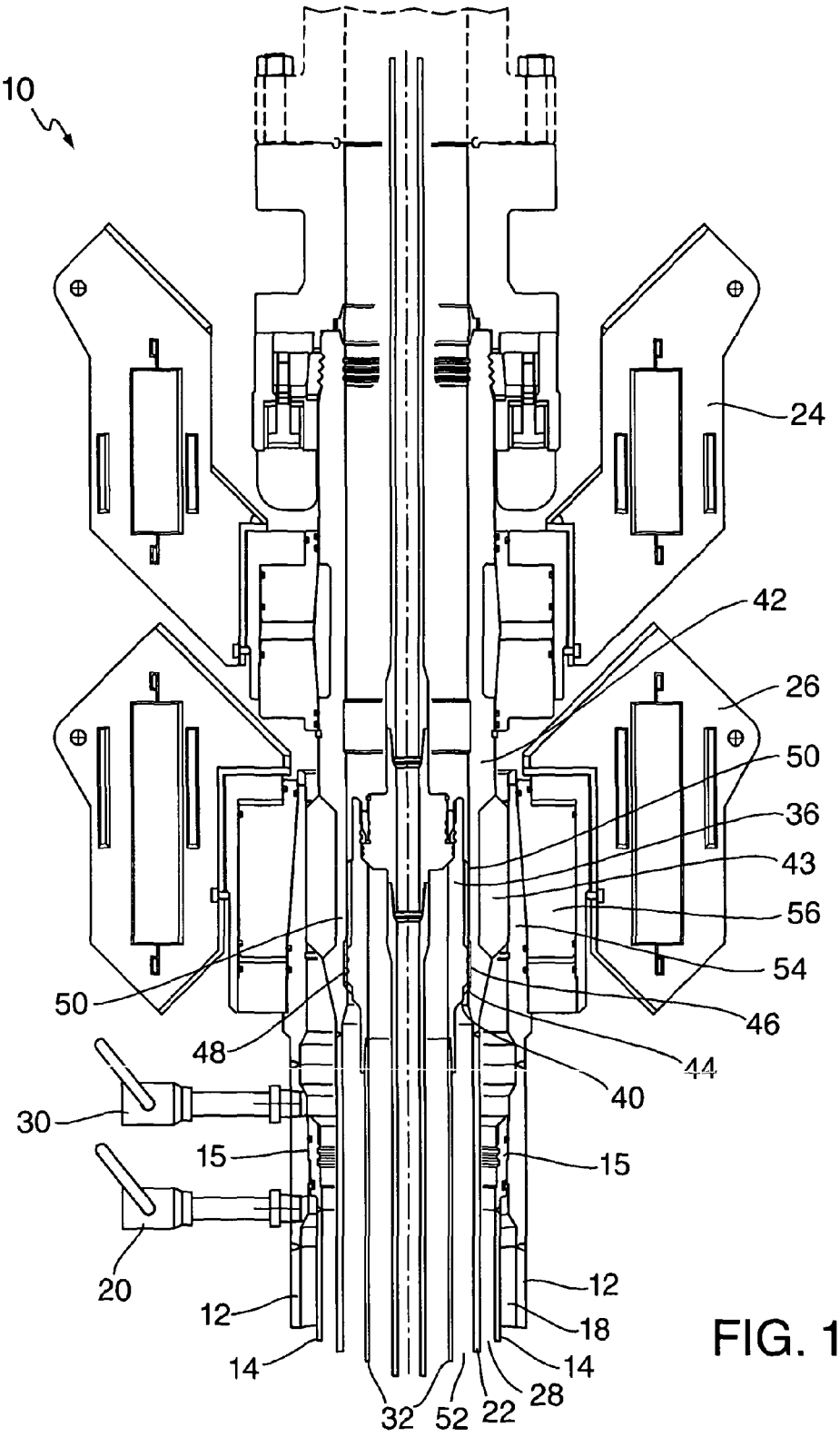
FIG. 1 is a cross-section of a preferred embodiment of a subsea wellhead with a first clamping arrangement in a first position.

As shown in FIG. 1, a wellhead 10 comprises a number of concentric casings suspended therefrom. In particular, a conductor 12 encompasses an intermediate casing 14 and in a particular embodiment a 36" conductor 12 encompasses a 28" casing string 14. The 28" casing string 14 includes a hanger 15 at the upper end thereof which effectively suspends the 28" casing string 14 from the conductor 12. The conductor 12 has a first wellhead housing 26 at an upper end thereof. The formation of the well includes passing cement down through the 28" casing string 14 and this cement then flows upwardly between the inner surface of the conductor 12 and the outer surface of the 28" casing string 14 in the annular space 18 defined therebetween. A valve 20 enables "cement returns" to flow out of the annular space 18 as the cement displaces such fluid. The valve 20 comprise a 28" hanger sub remotely operated vehicle (ROV) operated lower valve 20. The "cement returns" may predominantly comprise drill fluid.

The 28" casing string encompasses a 22" casing string 22 which is suspended from a second wellhead housing 24. Again, cement is passed down the 22" casing string 22 and then flows upwardly around the outer surface of the 22" casing string 22 and the inner surface of the 28" casing string 14 and into the annular space 28 defined therebetween. Again, a valve 30 enables "cement returns" to flow out of the annular space 28 as the cement displaces such fluid. This second valve 30 comprises a 28" hanger sub ROV operated upper valve 30.

The present invention relates primarily to the securement of the inner casing strings 32, 34 located within the 22" intermediate casing string 22.

The first inner casing string 32 comprises a 13⅜" casing string 32. In the present invention, the first inner casing string 32 is passed down the intermediate casing string 22. The first inner casing 32 has a hanger at the upper end thereof. The hanger includes an abutment surface around the periphery thereof. The abutment surface 38 is arranged to engage on and to be retained on a retaining shoulder 40 projecting inwardly from the intermediate casing 22 or specifically a sleeve 42 located at the upper end of the intermediate casing string 22. This position corresponds to a first securement position for the first inner casing string 32.

In particular, the hanger 36 of the first inner casing 32 includes splines 44 or longitudinal ribs around the circumference. These splines 44 or longitudinal ribs may locate and only extend for a part of the longitudinal extent of the first hanger 36. In particular, these splines 44 or longitudinal ribs only extend for a part of the lower portion of the hanger 36. The lower ends of the splines 44 or longitudinal ribs provide the abutment surface 38 on which the hanger 36 is supported on the retaining shoulder 40.

Directly above the splines 44 or longitudinal ribs, the hanger 36 comprises an outer sealing surface 46 which extends around the complete periphery thereof. The outer radial extent of the splines 44 or longitudinal ribs may substantially correspond to the radial extent of the outer sealing surface 46. In the first position, the outer sealing surface 46 locates adjacent to a groove 48 located on the inner wall of the intermediate casing 22 or sleeve 42.

The hanger 36 also comprises splines 50 or longitudinal ribs which extend longitudinally upwardly from the outer sealing surface 46. These splines 50 or longitudinal ribs are equally spaced around the circumference of the hanger 36.

These upper splines 50 or longitudinal ribs align with the lower splines 44 or longitudinal ribs with the outer sealing surface 46 located therebetween.

Figure 2:
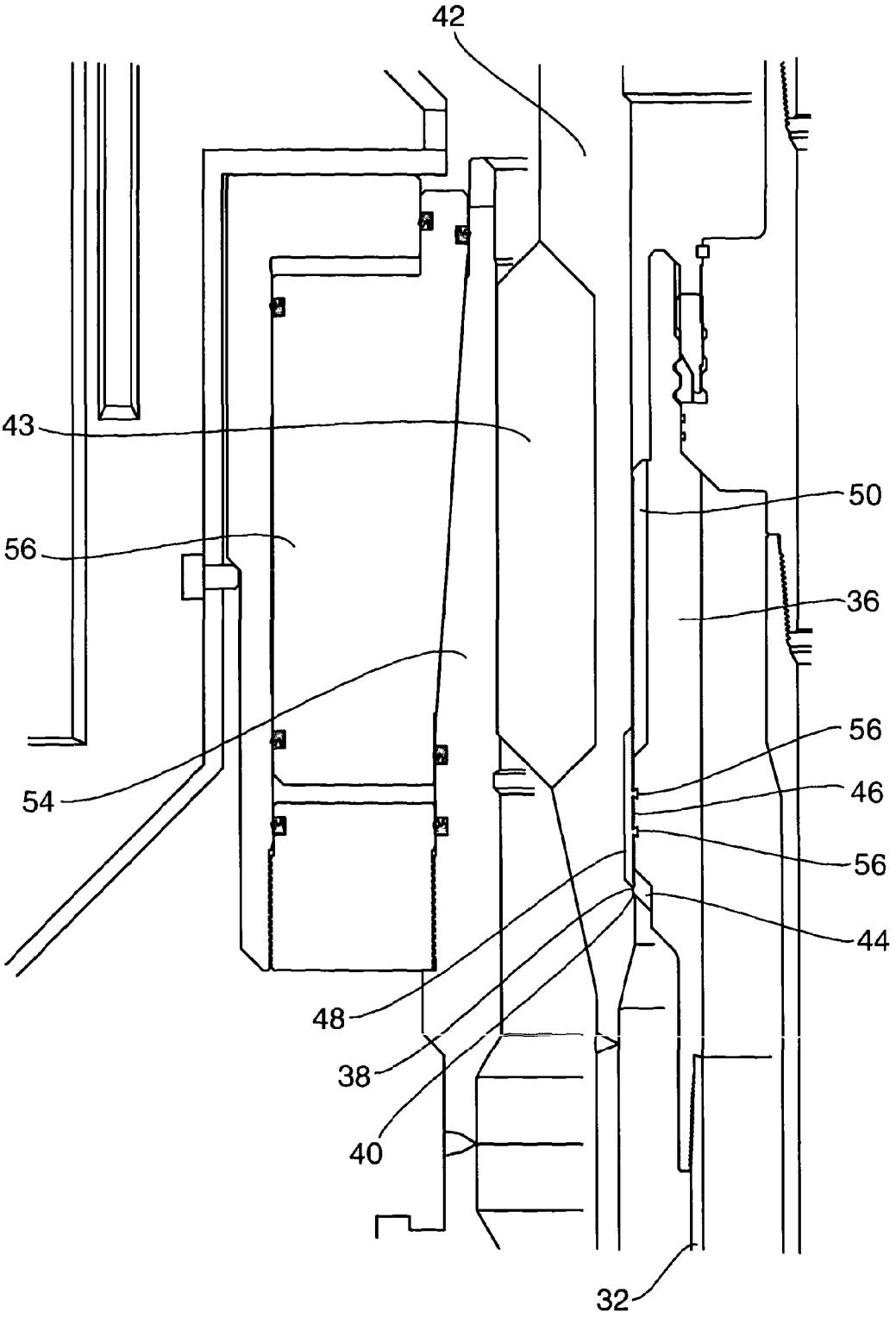
FIG. 2 is a detailed view of a part of a preferred embodiment of a first clamping arrangement in a first position within a preferred embodiment of a subsea wellhead.

As shown in FIG. 1 and FIG. 2, when the hanger 36 of the first inner casing 32 is supported on the retaining shoulder 40, the lower splines 44 provide a fluid passageway to enable fluid to flow upwardly from between the intermediate casing 22 and the first inner casing 32. This fluid can then flow upwardly between the outer sealing surface 46 and the intermediate casing 22 or sleeve 42 provided by the groove portion 48. The fluid can then pass through the passageways provided in the upper splines 50 or longitudinal ribs and the fluid can continue to flow upwardly through a tubular casing to the surface.

This continuous fluid passageway around the first inner casing 32 whilst the first inner casing 32 is suspended provides a passageway for "cement returns" to flow upwardly back to the surface without the need for remotely operated valves.

Accordingly, with the first inner casing 32 secured in the first position such that the lower ends of the splines 44 or longitudinal ribs are resting on the upper surface of the shoulder 40, cement can be passed down through the first inner casing 32 in order for the cement to flow upwardly in the annular spacing 52 provided between the outer surface of the first inner casing 32 and the inner surface of the intermediate casing 22. The fluid that is displaced by the cement produces "cement returns" and this fluid then flows through the lower splines 44, around the outer sealing surface 46, up through the upper splines 50 and finally the "cement returns" can flow to the surface through a tubular casing string extending from the wellhead 10 to the surface.

Figure 3:
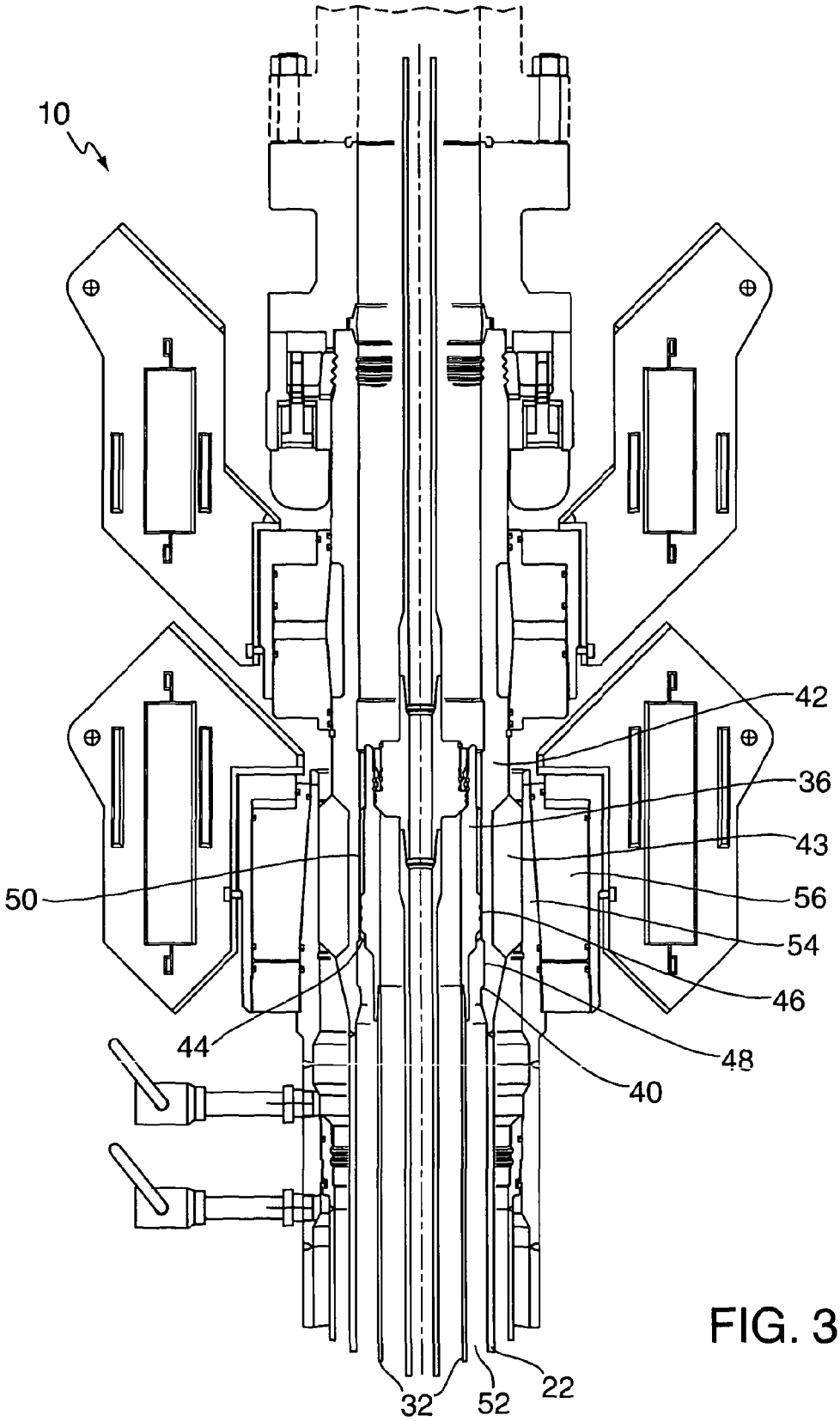
FIG. 3 is a cross-section of a preferred embodiment of a subsea wellhead with a first clamping arrangement in a second position.
Figure 4:
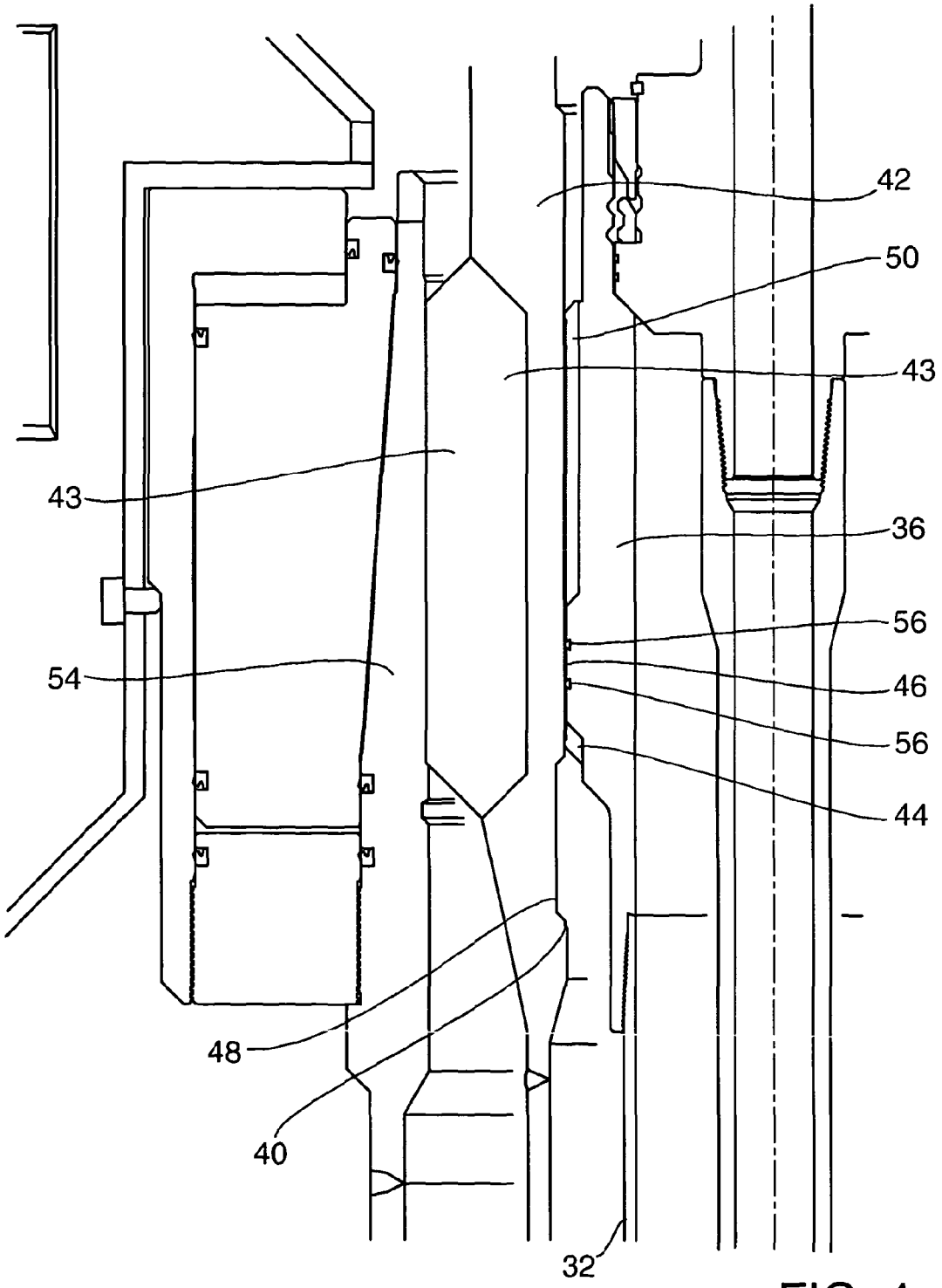
FIG. 4 is a detailed view of a part of a preferred embodiment of a first clamping arrangement in a second position within a preferred embodiment of a subsea wellhead.
Figure 5:
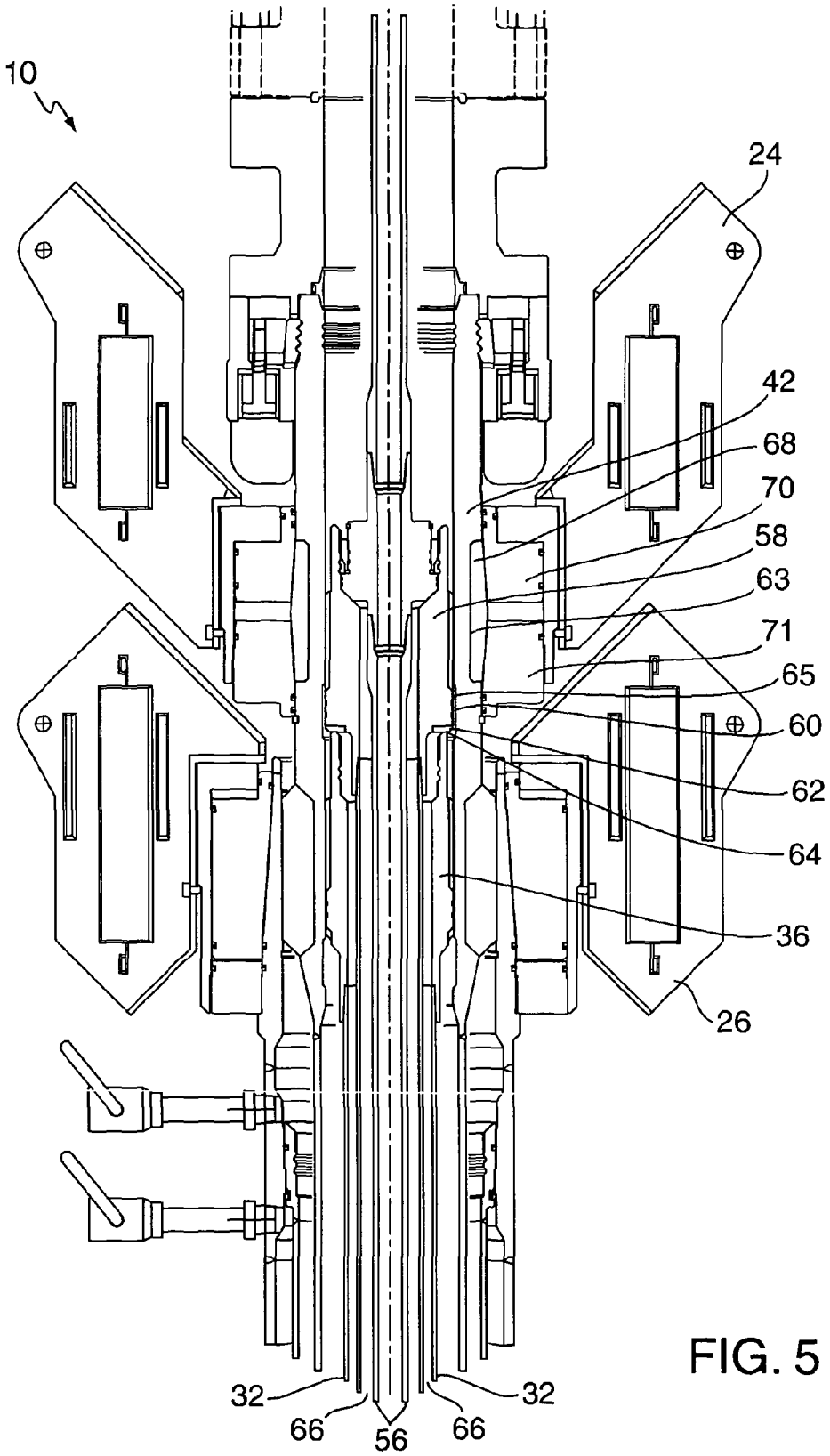
FIG. 5 is a cross-section of a preferred embodiment of a subsea wellhead with a second clamping arrangement in a first position and a first clamping arrangement in a second position.
Figure 6:
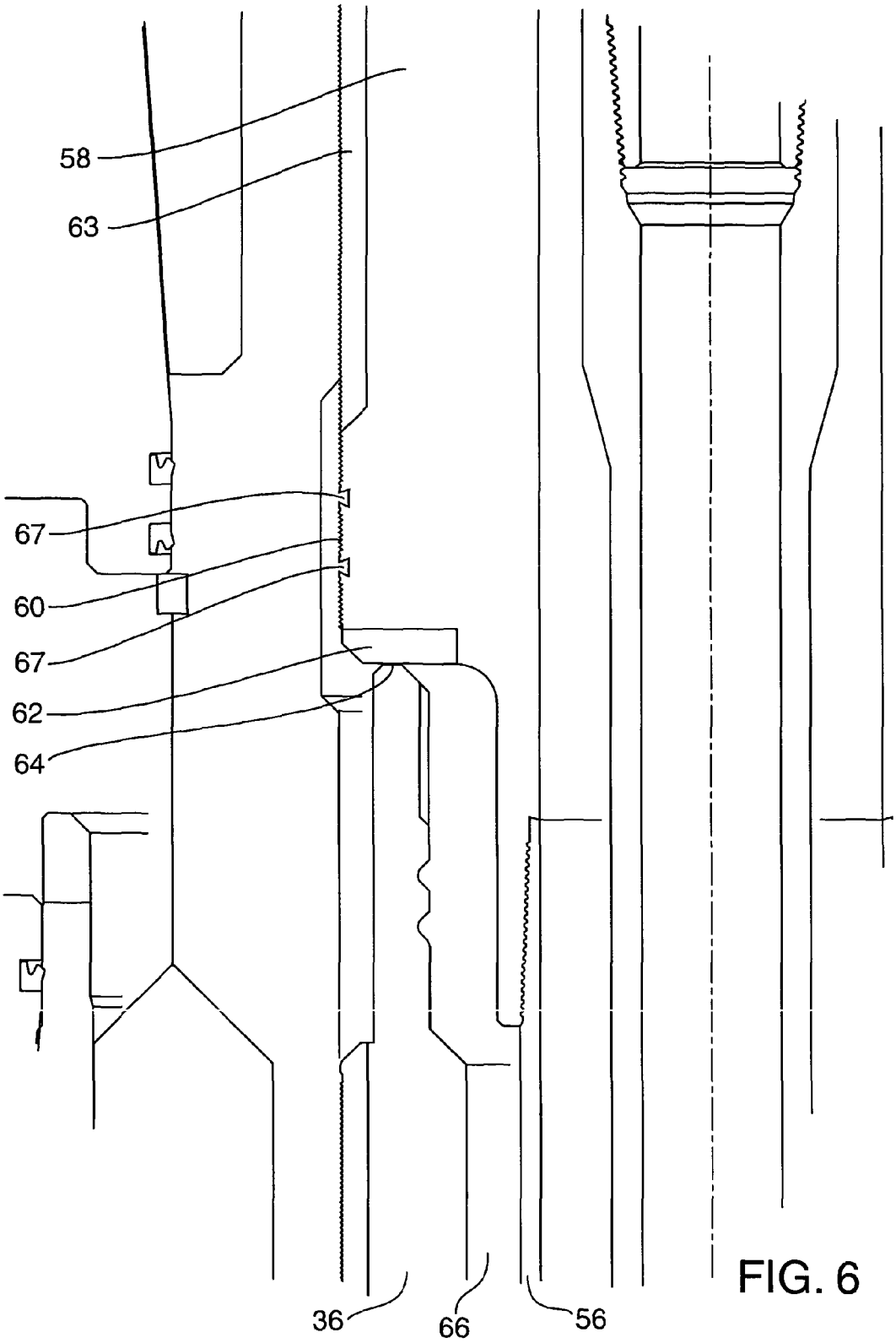
FIG. 6 is a detailed view of a part of a preferred embodiment of a second clamping arrangement in a first position within a preferred embodiment of a subsea wellhead.

As shown in FIG. 3 and FIG. 4, once cemented, the first inner casing string 32 is raised until the outer sealing surface 46 is located adjacent to the second securement means. The raising of the hanger 36 and the first inner casing string 32 may be a simple upwards movement only which may be gauged with reference to a particular reference point. In one example, the movement may be referenced to an index point provided by a part of the blowout preventer.

The second securement means comprises a clamping arrangement comprising a collar 54 having an externally tapered surface which cooperates with an annular component in the form of a compression ring 56. The compression ring 56 is axially movable relative to the compression collar 54 such that the cooperating tapered surfaces create an inwardly directed force which compresses the sleeve 42 on to the outer sealing surface 46. The force generated by the relative axial movement of the compression ring 56 relative to the compression collar 54 forms a metal to metal seal between the sleeve 42 and the hanger 36 of the first inner casing 32. The sleeve 42 may include a series of splines 43 or fins or longitudinal ribs around the outer circumference thereof in order to aid the compressive force generated by the compression of the sleeve 42. The splines 43 effectively increase the outer diameter of the sleeve at the location within the clamping arrangement.

In addition, the movement of the hanger 36 from the first position to the second position creates an axial load on the first casing string 32 and the clamping arrangement retains this axial load within the first casing string 32.

The outer sealing surface 46 of the hanger 36 creates a metal to metal seal between the hanger 36 and the sleeve 42. The outer sealing surface 46 may also comprise two O-rings 56 located longitudinally spaced apart on the outer sealing surface 46 to create a high grade seal.

The clamping arrangement clamps the hanger 36 and hence the first inner casing string 32 to prevent any longitudinal movement of the first inner casing string 32. In particular, the clamping arrangement prevents the weight of the string 32 pulling the first inner casing 32 downwardly. In addition, the clamping arrangement also prevents any upward pressure generated in the annular space 52 surrounding the first inner casing string 32 from moving the first inner casing string 32 upwardly. Accordingly, the first inner casing string 32 is held tight with a metal to metal seal and the first inner casing string 32 is maintained with an axial load.

The simple clamping arrangement creates a metal-to-metal seal and also prevents movement of the casing string 56 downwards and also prevents movement of the casing string 56 in an upwards direction.

As shown in FIG. 5 to FIG. 8, the wellhead arrangement includes a second wellhead housing 24 which locates above the first wellhead housing 26. The second wellhead housing 24 includes a second securement means for securing a second inner casing string 56 within the first inner casing string 32 in a similar arrangement.

The second inner casing string 56 comprises a 9⅝" casing string 56. The second inner casing string 56 includes a hanger 58 at the upper end thereof. The hanger 58 comprises an outer sealing surface 60 defined around the outer periphery thereof which is arranged to create a metal to metal seal with the sleeve 42.

The hanger 58 is again arranged to be supported in a first position whilst providing a fluid passageway to enable "cement return" to flow upwardly through a casing string to the surface.

The second hanger 58 includes radially extending ribs 62 or splines defined as the lower abutment surface of the hanger 58. The second hanger 58 is retained in a first position as the lower abutment surface 62 of the hanger 58 abuts a retaining shoulder 64 or surface provided by the first hanger 36.

Since the lower abutment surface 62 of the second hanger 58 comprises splines or ribs 62, this support means provides a plurality of fluid passageways.

The outer sealing surface 60 of the second hanger 58 is arranged to locate in an enlarged diameter 65 or groove of the sleeve 42 such that fluid can pass between the outer sealing surface 60 and the sleeve 42 whilst the hanger 58 is retained in the first position.

In this first position, cement can flow down the second inner casing string 56 and then flows upwardly in the annular space 66 between the outer surface of the second inner casing string 56 and the inner surface of the first inner casing string 32. As the cement enters this annular space 66, the cement displaces the fluid located therein which is then able to flow upwardly between the splines 62 or ribs of the hanger 58 and around the outer sealing surface 60 of the second hanger 58. The fluid then flows upwardly between upper splines 63 or longitudinal ribs provided on the second hanger 58 above the outer sealing surface 60. The "cement returns" can then flow upwardly to the surface.

Once the cement has cured, the second hanger 58 and the associated second inner casing string 56 can be raised upwardly in order for the outer sealing surface 60 of the second hanger 58 to locate adjacent to and within a second securement means comprising a clamping arrangement.

The clamping arrangement comprises a compression collar 68 including outwardly tapered surfaces. Two compression rings 70, 71 including respective inwardly tapered surface are arranged to locate around the tapered surfaces of the compression collar 68. These compression rings 70, 71 can be moved relative towards each other and over the externally tapered surfaces of the compression collar 68. This relative movement causes the compression collar 68 to compress and to deform the sleeve 42 inwardly such that the internal diameter of the sleeve 42 decreases and effectively squeezes the second hanger 58. In particular, this inward force creates a metal to metal seal between the outer sealing surface 60 of the second hanger 58 and the inner surface of the sleeve 42.

The outer sealing surface 60 includes two O-ring seals 67 to aid the seal created by the clamping force.

The clamping arrangement creates a metal-to-metal seal and also prevents movement of the casing string 56 downwards and also prevents movement of the casing string 56 in an upwards direction.

Figure 7:
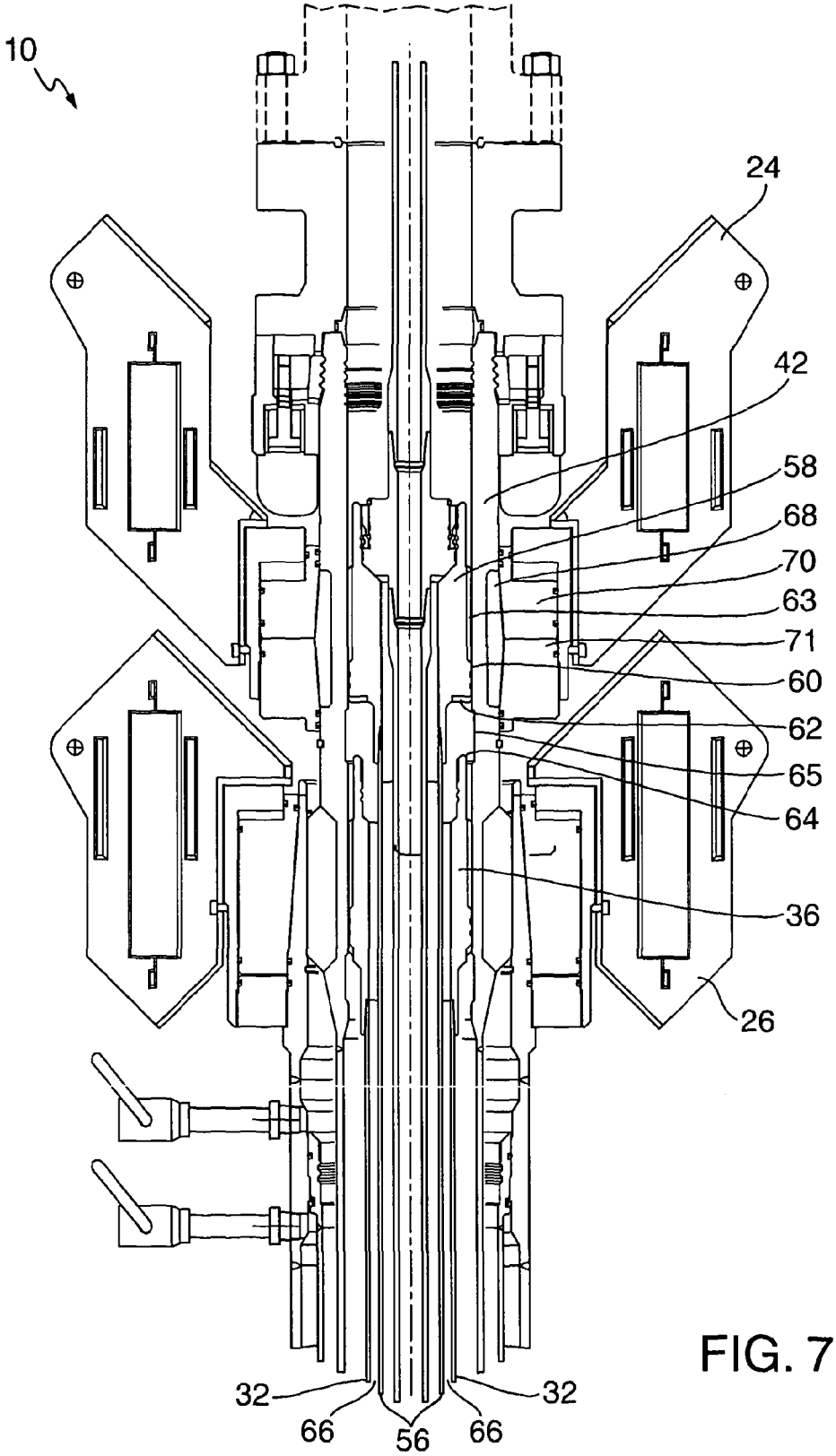
FIG. 7 is a cross-section of a preferred embodiment of a subsea wellhead with a second clamping arrangement in a second position and a first clamping arrangement in a second position.
Figure 8:
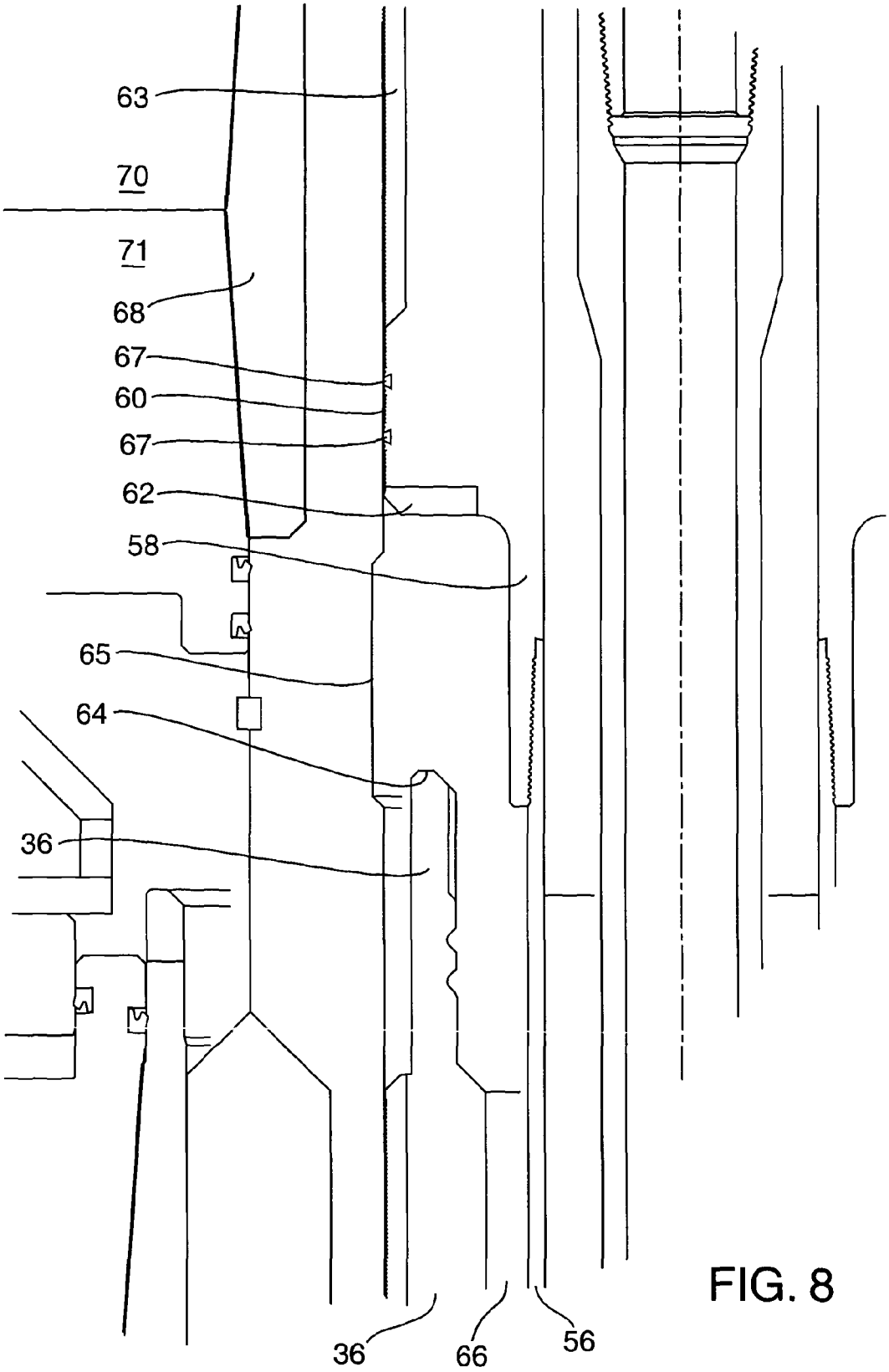
FIG. 8 is a detailed view of a part of a preferred embodiment of a second clamping arrangement in a second position within a preferred embodiment of a subsea wellhead.

As shown in FIG. 7 and FIG. 8, the second inner casing string 56 is raised after the cement has cured. This movement in the position of the top of the casing string 56 means that the second inner casing string 56 will include an axial load which will be maintained by the securement of the second hanger 58 in this second position. This movement is a simple upwards movement of the second inner casing string 56.

Accordingly, the present invention provides a wellhead arrangement 10 including a first inner casing string 32 which is held in axial loading and a second inner casing string 56 which is also held in axial loading. Both of the first and second inner casing strings 32, 56 are releasably clamped such that the casing strings 32, 56 cannot move in an upwards or a downwards longitudinal direction. Prior to being clamped in such a position, the wellhead arrangement 10 provides first retaining means to retain the first and second casing strings 32, 56 in cementing position whereby "cement returns" are able to flow around the respective hangers 36, 58 and upward through a casing towards the surface. Once cemented, the upper hangers 36, 58 of the respective inner casing strings 32, 56 are moved upwardly where the hanger is then clamped in position to maintain the respective inner casing strings 32, 56 under an axial load whilst being prevented from moving either upwardly or downwardly.

The present invention may be used in high pressure/high temperature subsea wellheads and may be used on jack-up exploration wells. The securement arrangement provides true metal-to-metal seals and delivers instant lockdown capability which can match the hanger capacity.

The present invention provides many advantages including the requirement of only a single trip installation of subsea hangers. The hangers are sealed and locked as soon as the cementing is complete. In addition, the full annulus pressure lockdown capacity for the hangers and may provide up to 4 million lbs. The present invention eliminates the use of prior art annular seals and lockdown sleeves.

Accordingly, the present invention has a greatly reduced installation time and also provides the capability of monitoring the integrity of the seal.

Furthermore, the present invention provides reliable metal-to-metal seals due to the elimination of movement, the large seal contact area, the multiple metal seals, the single leak path and the clamping seal has a proven capability of 20 000 psi from above and below (at 350 deg F.).

The present invention provides automatic preloaded lockdown of a wellhead to a conductor and has a big bore design with superior bending load resistance. The system has integral metal seals with no subsea seal installation and the multiple metal seals are energized by an external force with predictable capacity. The lockdown is instantaneous and there are no moving parts required on the hangers. There are no lock rings to be activated and the system provides a rigid metal-to-metal seal environment. The system may be used in a contaminated environment.

The installation of the system may include the provision of testing the blowout preventer with the wearbushings in place. The installation of the hangers is reversible and the system may include a positive wearbushing lockdown without rotation.

The present invention provides a simple and effective system for providing a lockdown arrangement for a casing string in which the casing string is held with a metal-to-metal seal and the casing string is locked from moving in either an upwards or a downwards direction. The clamping arrangement does not require the use of multiple components as used in the prior art. The clamping arrangement is a single simple system. In particular, the clamping arrangement is an effective and reliable system to provide a single activation for locking the casing string against upwards and downwards movement whilst simultaneously producing a metal-to-metal seal. The clamping arrangement produces a compressive force that creates a sufficient gripping capability to provide all three of these mentioned functionalities quickly, simply and simultaneously without the need for multiple separate components for providing each function. For example, prior art systems may require annular sealing components, components for locking the string against downwards movement and component for locking the string against upwards movement. Each of these three functions may have required separate components and each of these functions may have previously required separate activations. It will be appreciated that these extra multiple components and activations will introduce extra problems and additional components and activations which increase the risk for failure.

The present invention also provides monitoring means for monitoring the space and volume within a lower annulus. In particular, the monitoring means monitors the space and volume within the lower annulus 52 located between the inner surface of the 22" intermediate casing string 22 and the outer surface of the inner casing string 32. Furthermore, the monitoring means provides the capability to retrieve and/or introduce fluid(s) into the annular space 52.

The monitoring means provides a port, specifically a passageway 100 (a monitoring fluid passageway), which extends upwardly from the annular space 52. The passageway 100 is provided in a sleeve 102. The sleeve 102 is thereby a replacement sleeve for the sleeve 42 previously described. Accordingly, the sleeve 102 is located at the upper end of the intermediate casing string 22. The sleeve 102 provides the groove 48 and an inner sealing surface for sealing with the outer sealing surface 46 of the hanger 36 in the second secured position.

Figure 9:
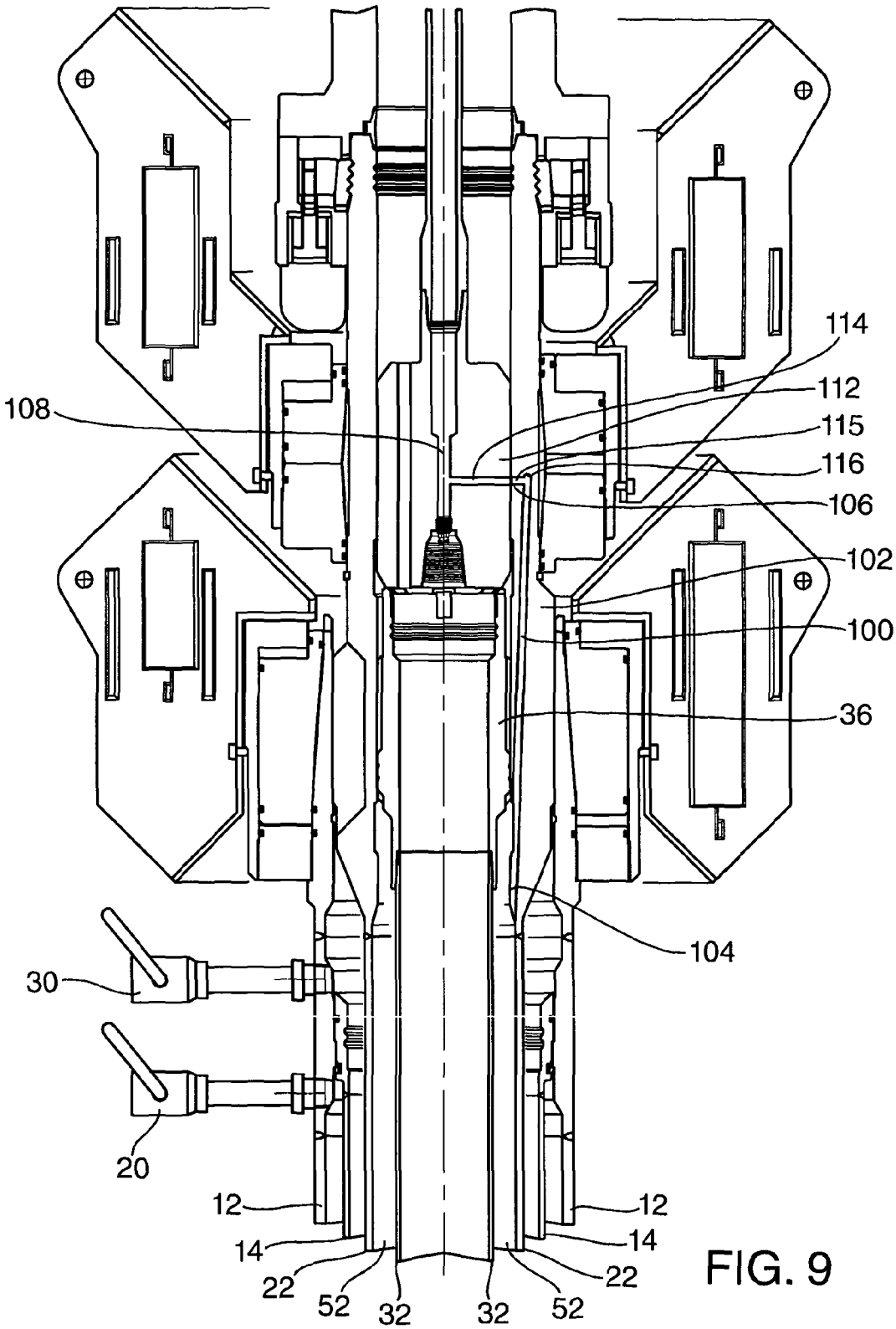
FIG. 9 is a cross-section of an embodiment of a subsea wellhead with first and second clamping arrangements together with annulus monitoring means in a remediation configuration.

As shown in FIG. 9, the passageway 100 includes a lower end 104 which provides an entrance/exit region. The lower end 104 is arranged to locate below the seal created between the hanger 36 and the sleeve 102 when the hanger 236 is in the second secured position. Similarly, an upper end 106 of the passageway 100 is arranged to locate above the seal created between the hanger 36 and the sleeve 102 when the hanger 36 is in the second upper secured position.

Accordingly, when the hanger 36 is in the second upper secured position, the passageway 100 provides a fluid communication (or conduit) which by-passes the seal such that fluid is able to pass between an upper conduit section 108 and the lower annular space 52.

The present invention thereby provides a passageway 100 which enables the space and volume within the lower annulus 52 to be monitored. This arrangement does not require any penetration of the well head and, in particular, does not require any penetration of the casings. A port including a valve which projects through the casing at a location below the well head could provide access to the annular space 52 but such an arrangement would be hazardous and risky. For example, if such a valve should fail then the consequences would be catastrophic for the well. In addition, various rules and regulations may specify that there can be no such penetration of the riser at this location.

The term monitoring is used to include the sensing of parameters and/or remediating a problem sensed within the annulus. In particular, the annulus monitoring path can also be used for remediation of any pressure build-up, typically called Sustained Casing Pressure (SCP). The remediation is to bleed off the pressure, or to introduce a remediation fluid, such as drilling mud to kill the leak, or cement to seal it.

Figure 10:
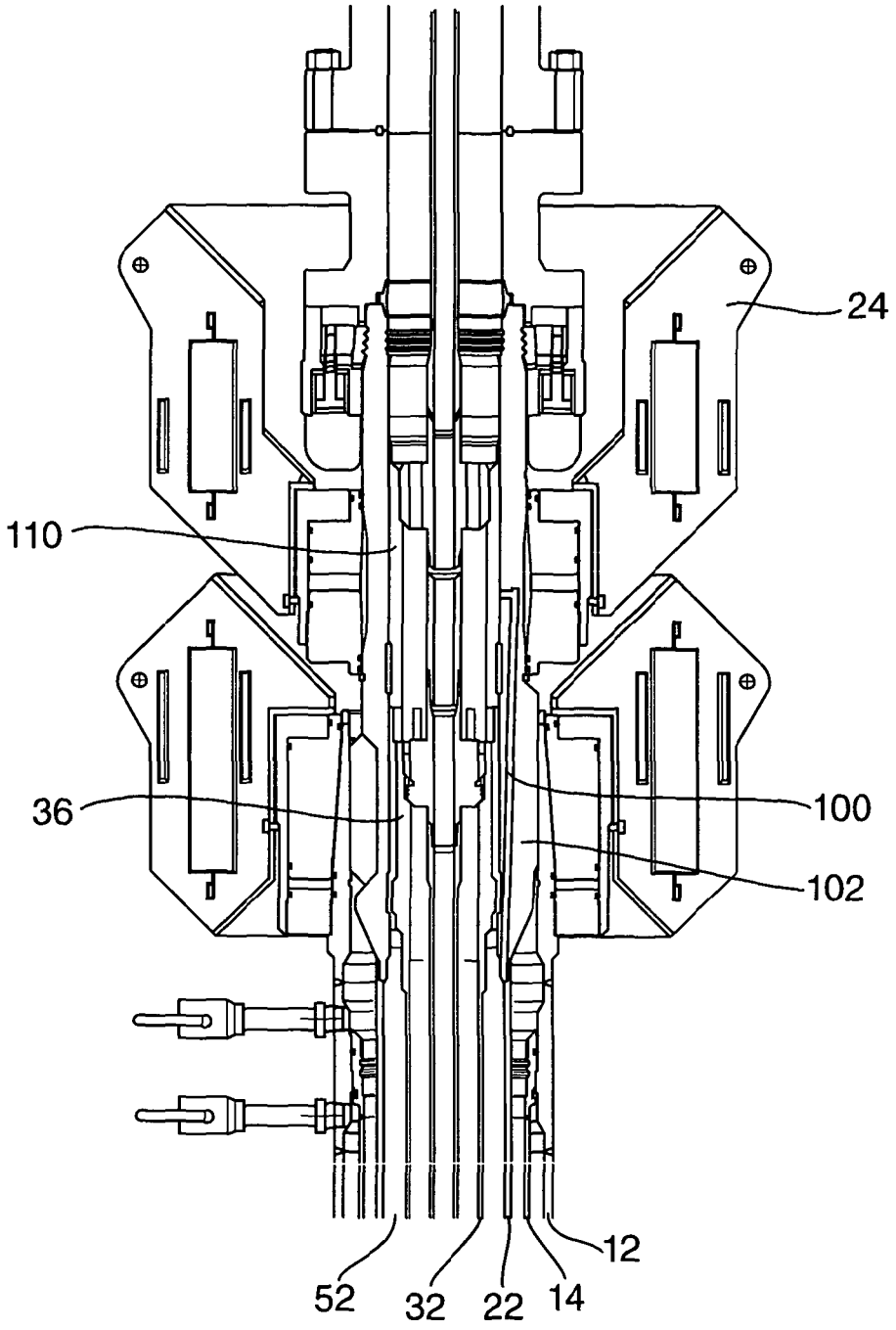
FIG. 10 is a cross-section of another embodiment of a subsea wellhead with first and second clamping arrangements with a sleeve providing a monitoring passageway and with an isolation sleeve and a hanger in a lower secured position.

In constructing the well head, an isolation sleeve 110 may be used, a shown in FIG. 10. The isolation sleeve 110 is arranged to be secured over the upper end 106 of the passageway 100 and thereby prevents the flow of fluid into the passageway 100. The isolation sleeve 110 may be used as a temporary sleeve during the construction of the well head. The isolation sleeve 110 is removed and then replaced with a monitoring hanger 112 which comprise a monitoring and tubing hanger. In the embodiment shown in FIG. 9, the monitoring hanger 12 does not have a casing suspended therefrom and the monitoring hanger is providing remediation means to remedy excess pressure detected within the annulus through the introduction or extraction of a fluid through the monitoring means.

The monitoring hanger 112 is arranged to be secured within the second (upper) well head housing 24. In particular, the monitoring hanger 112 is secured within the second securement means as previously described.

The monitoring hanger 112 provides a tool which can establish communication with, and control, the annulus within a drill pipe run tool through the riser. The monitoring hanger 112 can be deployed either before the tubing hanger has been installed or as an intervention by removing the tubing hanger and replacing it with the monitoring hanger 112.

As shown in FIG. 9, in a remediation configuration, the monitoring hanger 112 includes a central conduit 108 which includes a passageway 114 which extends radially outwards from the central conduit 108. The radial passageway 114 is arranged to be aligned with the upper end 106 of the passageway 100 provided in the sleeve 102. As previously explained, the lower end 104 of the passageway 100 fluidly connects the annulus 52 located below the lower hanger 36. Accordingly, the central conduit 108 of the monitoring hanger 112 is in fluid communication with the lower annulus 52 between the inner surface of the 22" casing string and the outer surface of the inner casing string 32. The central conduit 108 may be connected to the surface where further monitoring apparatus and sensors may be located. For example, the connection to the surface may be provided by an umbilical cord or another suitable connection. The sensors may comprise a pressure gauge and/or a temperature sensor or other fluid monitoring sensor. A pressure gauge may be located at the surface in the remediation configuration shown in FIG. 9 or an electric pressure gauge may be located in the Christmas tree 120 which is in communication with a surface station. In addition the monitoring means may include a remotely operated valve allowing access to the annulus such that a user can control the introduction of a fluid into the annulus or the extraction of a fluid from the annulus.

In this remediation configuration, a fluid may be introduced or extracted from the annulus. For example, the monitoring means may detect excess pressure within the annulus and/or the monitoring means may detect the presence of excess oil/gas within the annulus which should not be present. The monitoring means enables a volume of this excess fluid to be extracted from the annulus through the passageway 100 and into the central conduit 108. The excess fluid can then flow through the central conduit 108 for removal. Alternatively, the problem of the excess fluid or unwanted fluid can be resolved through the introduction of a fluid (e.g. mud, cement etc.) into the annulus. This may help to resolve a bleed of a fluid (e.g. oil, gas etc.) into the annulus. The introduction of the fluid may comprise forcing the fluid down the central conduit 108, through the passageway 100 and into the annulus 52. Accordingly, the monitoring means provides remediation means. The monitoring means monitors/detects any pressure build up over time of oil/gas in the annulus where it should not be and the monitoring means can then remedy this problem. For example, the monitoring means can bleed off the excess pressure and then shut off this connection or a pump can be attached to the monitoring means in order for mud/cement to be pumped into the annulus to stop further bleeding. Accordingly, the passageway 100 provides fluid access to the annulus to enable bleeding off to be conducted or to enable the introduction of a remediation fluid.

The sleeve 102 including the passageway 100 extends between both the first (lower) securement means and the second (upper) securement means of the well head. As shown in FIG. 9, the passageway 100 has a lower entrance 104 which locates below the sealing surface of the hanger 36. The passageway 100 is angled radially outwardly as the passageway 100 extends upwardly until the passageway 100 provides a corner section 116. The passageway 100 then extends radially inwardly as a linear section 115 along a radius of the sleeve 102.

This linear section 115 provides an exit region which is arranged to be aligned with a passageway 114 provided in the monitoring hanger 112.

Figure 11:
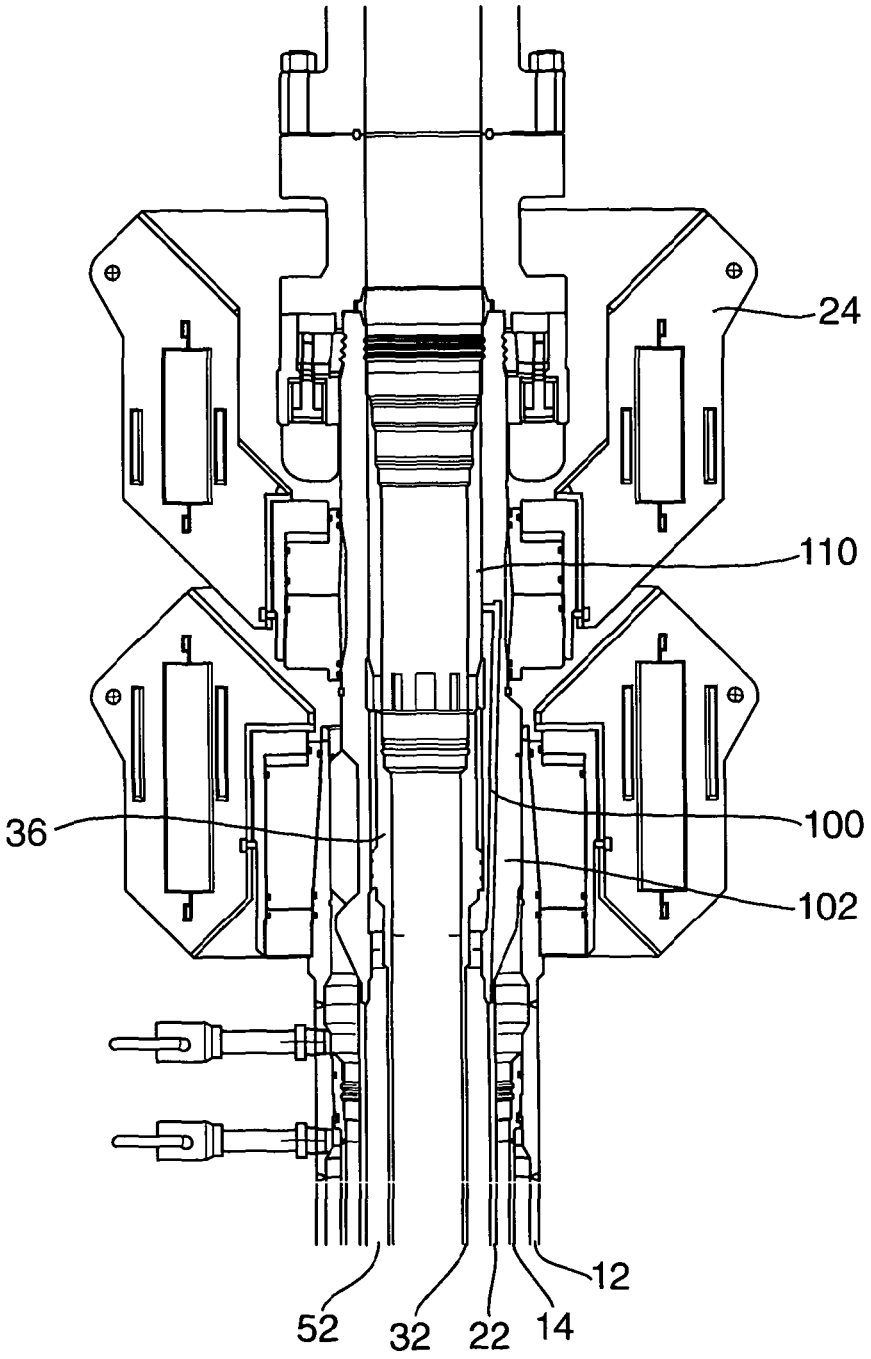
FIG. 11 is a cross-section of another embodiment of a subsea wellhead with first and second clamping arrangements with a sleeve providing a monitoring passageway and with an isolation sleeve and a hanger in an upper secured position.

The installation of the monitoring means will now be described further, with particular reference to FIG. 10 to FIG. 12.

Initially the production casing hanger 36 together with the isolation sleeve 110 are installed. The assembly is landed with the casing hanger 36 being supported on the shoulder 40 provided by the sleeve 102 which is located at the top of the intermediate casing string 22, as shown in FIG. 10. The casing 32 is then cemented in position with the excess cement/displaced fluid being extracted as previously described. The casing hanger 36 and isolation sleeve 110 are then raised into the setting position and the annular seals are set using the lower securement means. The lower securement means are actuated to seal the casing hanger 36 in position and the upper securement means are actuated to seal the isolation sleeve 110 in position, as shown in FIG. 11 with the handling tool removed.

The arrangement may have a pressure test conducted in this configuration. The handling tool which installed and set the lower casing hanger 36 and the isolation sleeve 110 can then be removed. The drilling programme can then be continued. The installation process may include conducting weekly blow out prevention tests using any suitable test tool which can be selectively extended into and removed from the well head.

The isolation sleeve 110 can then be removed from the arrangement. The upper securement means are disengaged and the isolation sleeve 110 is then removed using a handling tool. Once removed, the completion assembly and tubing hanger can be installed, as shown in FIG. 12 which shows the monitoring means in a production configuration. This includes the operation of the second securement means in the second well head housing 24 to set the annular seals for the annulus monitoring and to secure the tubing hanger 112 in position. Once secured, wireline plugs are connected to and installed in the tubing hanger 112. The tubing hanger handling tool and drilling riser can then be removed.

Figure 12:
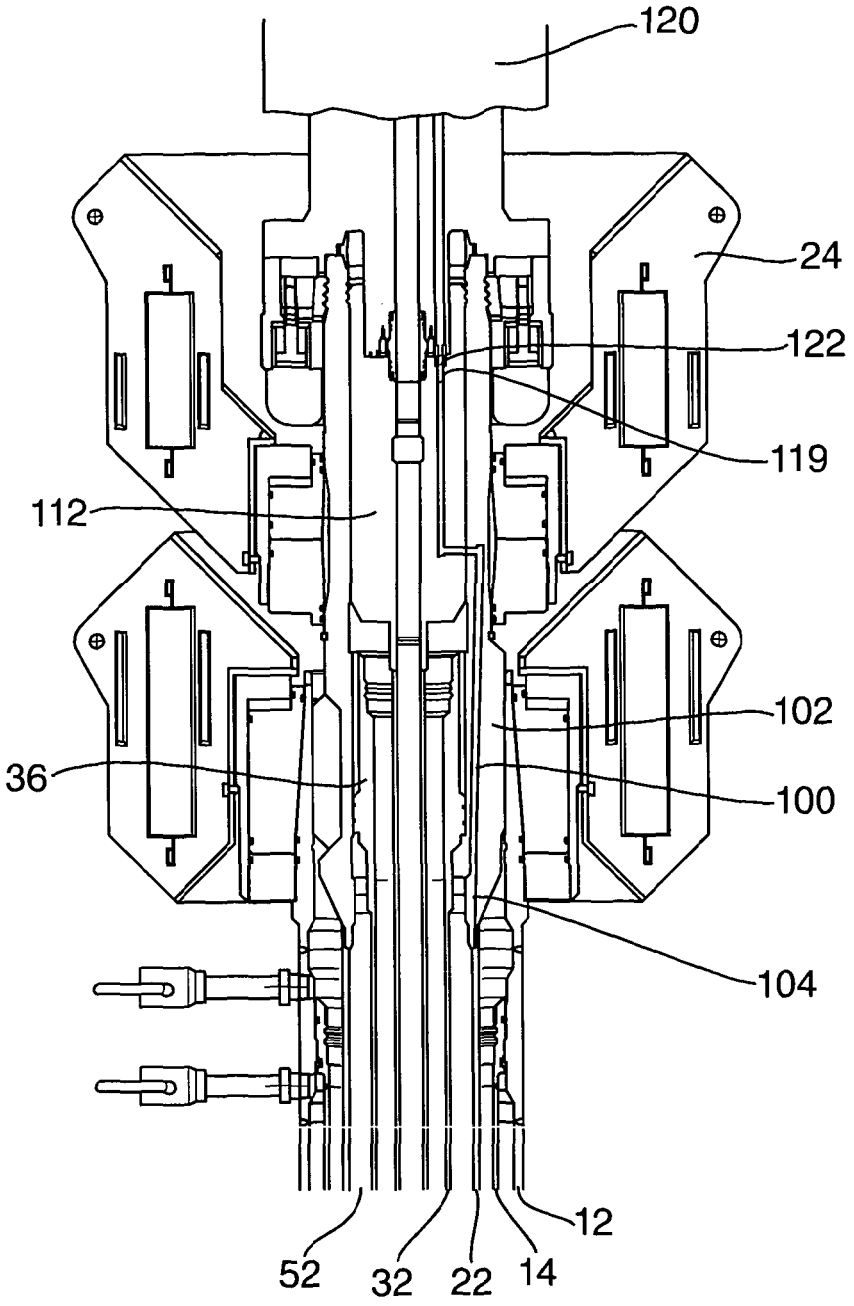
FIG. 12 is a cross-section of another embodiment of a subsea wellhead with first and second clamping arrangements with a monitoring hanger aligned with a sleeve providing a monitoring passageway, the monitoring means being in a production configuration.

Once the drilling riser has been removed, a Christmas tree assembly 120 can be installed above the second well head housing 24, as shown in FIG. 12. The Christmas tree assembly 120 is installed above the second well head housing 24 and the Christmas tree assembly 120 includes a connector 122 which stabs into an annulus monitoring port 119 provided in the tubing hanger 112. Finally the wireline plug is removed and the well is complete.

The invention claimed is:

1. A securement arrangement for securing a hanger within a subsea wellhead, comprising:

a hanger comprising:

an outer sealing surface;

a plurality of first longitudinal ribs located below the outer sealing surface and a plurality of second longitudinal ribs located above the outer sealing surface, the outer radial extent of each of the first and second longitudinal ribs corresponds to the radial extent of the outer sealing surface, and the first and second longitudinal ribs and the outer sealing surface being in fixed positions relative to each other;

an abutment surface provided by the first longitudinal ribs;

a tubular member comprising an inner radial sealing surface and a retaining shoulder arranged to support the hanger in a first position relative to the sleeve; and a clamping arrangement arranged to secure the hanger in a second position relative to the sleeve and to form a seal between the outer sealing surface of the hanger and the inner sealing surface of the tubular member;

wherein, in the first position the abutment surface is in contact with the retaining shoulder, the second longitudinal ribs are in contact with the inner sealing surface, and a fluid passageway is provided through the first longitudinal ribs, over the outer sealing surface and through the second longitudinal ribs, and wherein, in the second position the first longitudinal ribs, second longitudinal ribs and the outer sealing surface are in contact with the inner sealing surface such that fluid cannot flow around the outer sealing surface of the hanger.

2. The securement arrangement of claim 1, wherein the clamping arrangement secures the hanger in a first longitudinal direction and in an opposite second longitudinal direction in order to prevent movement of the hanger in either the first or second longitudinal direction.

3. The securement arrangement of claim 1, wherein the clamping arrangement provides an axial loading on a casing secured below the hanger.

4. The securement arrangement of claim 3, wherein the casing is secured within a well by cement.

5. The securement arrangement of claim 1, wherein the retaining shoulder is arranged, in use to cooperate with the abutment surface on the hanger in order to suspend the hanger in the first position.

6. The securement arrangement of claim 5, wherein the retaining shoulder is provided on a section of tube already suspended or secured within the subsea wellhead.

7. The securement arrangement of claim 5, wherein the retaining shoulder is provided by a sleeve already secured within the subsea wellhead.

8. The securement arrangement of claim 5, wherein the retaining shoulder is provided by a hanger already secured within the subsea wellhead.

9. The securement arrangement of claim 1, wherein, in the first position, the outer sealing surface of the hanger is arranged to locate at a longitudinal position in which the outer sealing surface is spaced apart from the inner sealing surface of the tubular member provided in the subsea wellhead in order to define an annular flow path around the outer sealing surface.

10. The securement arrangement of claim 1, wherein a lower surface of the first longitudinal ribs provides the abutment surface on the hanger.

11. The securement arrangement of claim 1, wherein adjacent longitudinal ribs of the first and second longitudinal ribs define a fluid passageway therebetween.

12. The securement arrangement of claim 1, wherein the outer sealing surface comprises an outer metal surface to create a metal to metal seal in the second position.

13. The securement arrangement of claim 1, wherein the fluid passageway enables cement returns to flow up from an annular space around the hanger and a suspended casing.

14. The securement arrangement of claim 1, wherein the securement arrangement enables cement to flow down a casing and then up around an outer surface of the casing and cement returns may then flow up around the hanger and upwardly therefrom.

15. The securement arrangement of claim 1, wherein the securement arrangement further comprises a lower securement arrangement and an upper securement arrangement, the lower securement arrangement comprising a lower retaining shoulder to support a lower hanger in a first position and a lower clamping arrangement to secure the lower hanger in a second position, the lower retaining shoulder being arranged, in use, to retain the lower hanger in the first position in which a fluid passageway is provided over an outer sealing surface of the lower hanger such that fluid can flow around the outer sealing surface of the lower hanger, the lower clamping arrangement providing a seal around the lower hanger whilst the lower hanger is secured in the second position such that fluid cannot flow around the outer sealing surface of the lower hanger, the upper securement arrangement comprising an upper retaining shoulder to support an upper hanger in a first position and an upper clamping arrangement to secure the upper hanger in a second position, the upper retaining shoulder being arranged, in use, to retain the upper hanger in the first position in which a fluid passageway is provided over an outer sealing surface of the upper hanger such that fluid can flow around the outer sealing surface of the upper hanger, the upper clamping arrangement providing a seal around the upper hanger whilst the upper hanger is secured in the second position such that fluid cannot flow around the outer sealing surface of the upper hanger.

16. The securement arrangement of claim 1, wherein the clamping arrangement comprises:

a collar having an externally tapered surface; and an annular component with an internally tapered surface, the collar and the annular component being relatively axially moveable between a first position in which the tapered surface of the annular component exerts no radial force on the collar and a second position which the tapered surface of the annular component exerts sufficient radial force to distort the collar inwardly to grip the hanger.

17. The securement arrangement of claim 16, wherein the annular component comprises a compression ring, or the collar comprises a compression collar.

18. The securement arrangement of claim 1, wherein the clamping arrangement simultaneously creates a metal-to-metal seal for a casing string suspended from the hanger whilst creating a lockdown mechanism for preventing both upwards movement and downwards movement of the casing string.

19. The securement arrangement of claim 1, further comprising a monitoring means for monitoring an annular space located below the hanger.

20. The securement arrangement of claim 19, wherein the monitoring means comprises a monitoring hanger, or a fluid sensor located above the hanger.

21. The securement arrangement of claim 20, wherein the monitoring hanger comprises a fluid passageway which is aligned with an aperture of a fluid passageway in a sleeve and wherein the monitoring hanger further comprises a monitoring port for a connector to communicate from the subsea wellhead to the surface.

22. The securement arrangement of claim 19, wherein the monitoring means includes a monitoring fluid passageway which provides remediation means remedying pressure build-up in the annular space below the hanger by introducing or extracting fluid through said monitoring fluid passageway.

23. The securement arrangement of claim 1, wherein:

the tubular member comprises a portion having an enlarged diameter;

and the fluid passageway is formed between the outer sealing surface of the hanger and the enlarged diameter portion of the tubular member while the hanger is in the first position.

24. The securement arrangement of any of claims 1-3, wherein the fluid passageway enables cement returns to flow up from an annular space around the hanger and a suspended casing and wherein the fluid is arranged to flow through the first longitudinal ribs, around the outer sealing surface and up through the second longitudinal ribs.

25. The securement arrangement of claim 1, wherein the tubular member is one of a casing, a hanger or a sleeve.

26. The securement arrangement of claim 1, wherein the abutment surface is spaced apart from the retaining shoulder when the hanger is in the second position.

27. A method of securing a hanger within a subsea wellhead, the hanger comprising an outer sealing surface, a plurality of first longitudinal ribs located below the outer sealing surface and a plurality of second longitudinal ribs located above the outer sealing surface, the first and second longitudinal ribs and the outer sealing surface being in fixed positions relative to each other, and the method comprising:

supporting the hanger in a first position by contact between an abutment surface of the hanger and a retaining shoulder;

the retaining shoulder securing the hanger in a single longitudinal direction while enabling movement of the hanger in a second opposite longitudinal direction;

providing a fluid passageway through the first longitudinal ribs, over the outer sealing surface of the hanger and through the second longitudinal ribs whilst the hanger is retained in the first position such that fluid can flow around the outer sealing surface of the hanger;

moving the hanger from the first position to a second position, the second position being located above the first position in the subsea wellhead;

securing the hanger in the second position with a clamping arrangement; and clamping the hanger in order to provide a seal between the outer sealing surface of the hanger and an inner sealing surface of the subsea wellhead whilst the hanger is secured in the second position such that fluid cannot flow around the outer sealing surface of the hanger, the second longitudinal ribs being in contact with the inner sealing surface when the hanger is in both the first position and the second position.

* * * * *